US010258218B2

(12) United States Patent
Lee et al.

(10) Patent No.: US 10,258,218 B2
(45) Date of Patent: Apr. 16, 2019

(54) DISHWASHER

(71) Applicant: LG ELECTRONICS INC., Seoul (KR)

(72) Inventors: Jongmin Lee, Seoul (KR); Yongjin Choi, Seoul (KR); Soohan Eo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 426 days.

(21) Appl. No.: 14/832,260

(22) Filed: Aug. 21, 2015

(65) Prior Publication Data

US 2016/0051122 A1 Feb. 25, 2016

(30) Foreign Application Priority Data

Aug. 22, 2014 (KR) ..... 10-2014-0109476

(51) Int. Cl.
*A47L 15/42* (2006.01)

(52) U.S. Cl.
CPC ..... *A47L 15/4234* (2013.01); *A47L 15/4285* (2013.01); *A47L 2501/06* (2013.01)

(58) Field of Classification Search
CPC ..... A47L 15/4234; A47L 15/4285; A47L 2501/06
USPC ..... 134/57 D
See application file for complete search history.

(56) References Cited

U.S. PATENT DOCUMENTS

| | | | | |
|---|---|---|---|---|
| 6,182,674 | B1 * | 2/2001 | Jozwiak | A47L 15/0049 134/104.1 |
| 2008/0011340 | A1 * | 1/2008 | Kim | A47L 15/4225 134/56 D |
| 2012/0097200 | A1 * | 4/2012 | Fountain | A47L 15/22 134/56 D |
| 2012/0279527 | A1 * | 11/2012 | Lee | A47L 15/0036 134/106 |

FOREIGN PATENT DOCUMENTS

| | | | | |
|---|---|---|---|---|
| CN | 1931080 | A | 3/2007 | |
| CN | 1973751 | A | 6/2007 | |
| CN | 101332070 | A | 12/2008 | |
| DE | 8226655 | U | 4/1987 | |
| DE | 29800704 | U1 | 5/1999 | |
| DE | 19844898 | A1 * | 4/2000 | A47L 15/4285 |
| EP | 0906984 | A1 | 4/1999 | |
| EP | 2100996 | A1 | 9/2009 | |
| JP | 2005296546 | A | 10/2005 | |
| KR | 1020060124285 | | 12/2006 | |
| KR | 1020130070275 | | 6/2013 | |
| WO | 2008071794 | A1 | 6/2008 | |

* cited by examiner

*Primary Examiner* — Michael E Barr
*Assistant Examiner* — Tinsae B Ayalew
(74) *Attorney, Agent, or Firm* — Dentons US LLP

(57) ABSTRACT

A dishwasher including a cabinet assembly having a tub in which dishes are received, a sump, having a water collection unit configured to store wash water disposed therein, which is coupled to an interior of the cabinet assembly to collect wash water and to supply steam generated in the water collection unit into the cabinet assembly, and a heater module located outside the sump to transfer heat to the water collection unit and to heat the wash water in order to generate steam. The heater does not contact the wash water, preventing corrosion or oxidation of the heater.

11 Claims, 3 Drawing Sheets

DISHWASHER

CROSS-REFERENCE TO RELATED APPLICATION

This application claims the priority benefit of Korean Patent Application No. 10-2014-0109476, filed on Aug. 22, 2014, in the Korean Intellectual Property Office, the disclosure of which is incorporated herein by reference.

BACKGROUND

1. Field

The present disclosure relates to a dishwasher.

2. Description of the Related Art

A dishwasher is an electric home appliance that sprays high-pressure wash water onto dishes through a spray nozzle to remove food waste from the surfaces of the dishes.

A conventional dishwasher includes a tub having a washing space defined therein and a sump mounted at the bottom of the tub to store wash water.

The wash water in the sump is moved to the spray nozzle by the pumping action of a washing pump mounted in the sump. The wash water moved to the spray nozzle is sprayed at a high pressure through a spray port formed in the end of the spray nozzle. The wash water sprayed at the high pressure strikes the surfaces of the dishes. As a result, food waste is separated from the dishes, and then falls to the bottom of the tub.

A heater configured to heat the wash water to a high temperature is mounted at one side of the sump. The wash water stored in the sump is moved into the heater, and heated.

In the conventional dishwasher, the wash water is heated by the heater, and then the heated wash water is sprayed into the tub to wash the dishes at a high pressure. However, the heater heats wash water in a state in which the heater directly contacts the wash water. For this reason, the heater is corroded by wash water upon repeated use of the dishwasher. Furthermore, foreign matter contained in wash water attaches and hardens on the surface of the heater resulting in the performance of the heater being reduced.

In the conventional dishwasher, the heater is disposed in the sump in which the wash water is stored, such that the heater can heat the wash water in a state in which the heater directly contacts the wash water. However, since the heater is disposed in the sump, the structure of the dishwasher is complicated.

In addition, in the conventional dishwasher, it is necessary to insulate the heater in order to prevent an electric shorting since the heater directly contacts wash water.

An example of a conventional dishwasher is disclosed, for example, in Korean Registered Patent No. 10-1235952.

SUMMARY

Therefore, the present disclosure has been made in view of the above problems, and it is an object of the present disclosure to provide a dishwasher including a heater module that can easily be manufactured.

It is another object of the present disclosure to provide a dishwasher configured to have a structure in which a heater does not contact the wash water.

It is another object of the present disclosure to provide a dishwasher that is capable of minimizing corrosion of a heater.

It is another object of the present disclosure to provide a dishwasher including a heater that exhibits high operating reliability.

It is another object of the present disclosure to provide a dishwasher including a heater that can be installed without consideration of an electric short.

It is another object of the present disclosure to provide a dishwasher that is capable of easily heating wash water by rapid thermal conduction and based on a large contact area.

It is a further object of the present disclosure to provide a dishwasher including a heater module that can easily be repaired or replaced.

In accordance with an aspect of the present disclosure, the above and other objects can be accomplished by the provision of a dishwasher including a cabinet assembly having a tub in which dishes are received, a sump, having a water collection unit to store wash water disposed therein, connected to an interior of the cabinet assembly to collect wash water and to supply steam generated in the water collection unit into the cabinet assembly, and a heater module located outside the sump to transfer heat to the water collection unit and to heat the wash water in order to generate steam.

The heater module may include a heater cover mounted to the sump such that the heater cover tightly contacts the sump to transfer heat to the water collection unit, a heater installed in the heater cover to generate heat when electric power is applied to the heater, and a temperature control module connected to the heater to control electric power applied to the heater based on temperature of the heater.

The heater cover may be provided with a heater installation portion, in which the heater is installed.

The heater installation portion may be formed in a ring shape.

At least a portion of the heater may be inserted in the heater installation portion.

The temperature control module may include a temperature fuse to regulate the electric power based on a temperature of the heater, and a wire electrically connected between the temperature fuse and the heater.

The temperature control module may further include a thermal bridge disposed between the heater and the temperature fuse to transfer the heat from the heater to the temperature fuse by thermal conduction.

The temperature control module may further include a heater shield coupled to the heater cover to prevent exposure of the heater.

The steam in the water collection unit may be supplied into the cabinet assembly in opposite directions through a steam channel connected between the water collection unit and the cabinet assembly and a filter channel configured to collect wash water from the cabinet assembly to the water collection unit.

The heater module may include a heater cover mounted to the sump such that the heater cover tightly contacts the sump to transfer heat to the water collection unit, a heater installed in the heater cover to generate heat when electric power is applied to the heater, a temperature fuse to regulate the electric power based on a temperature of the heater, a wire electrically connected between the temperature fuse and the heater, and a thermal bridge disposed between the heater and the temperature fuse to transfer the heat from the heater to the temperature fuse by thermal conduction.

The steam in the water collection unit may be supplied into the cabinet assembly in opposite directions through a steam channel connected between the water collection unit and the cabinet assembly and a filter channel configured to collect wash water from the cabinet assembly to the water collection unit.

In accordance with another aspect of the present invention, there is provided a dishwasher including a cabinet assembly in which dishes are received, a sump, having a water collection unit to store wash water disposed therein, connected to an interior of the cabinet assembly to collect wash water and to supply steam generated in the water collection unit into the cabinet assembly, a heater module located outside the sump to transfer heat to the water collection unit and to heat the wash water in order to generate steam, a steam channel connected between the water collection unit and the cabinet assembly, and a filter channel to collect wash water from the cabinet assembly into the water collection unit, wherein the steam generated in the sump is supplied into the cabinet assembly in opposite directions through the steam channel and the filter channel, and the heater module includes a heater cover mounted to the sump such that the heater cover tightly contacts the sump to transfer heat to the water collection unit, a heater installed in the heater cover to generate heat when electric power is applied to the heater, and a temperature control module connected to the heater to control electric power applied to the heater based on temperature of the heater.

In accordance with a further aspect of the present invention, there is provided a dishwasher including a sump, having a water collection unit to store wash water disposed therein and being coupled to an interior of a cabinet assembly in which dishes are received, to collect wash water and to supply steam generated in the water collection unit into the cabinet assembly, and a heater module, located outside the sump such that the heater module does not contact the wash water, to transfer heat to the water collection unit by conduction and to heat the wash water in order to generate steam.

BRIEF DESCRIPTION OF THE DRAWINGS

The above and other objects, features, and other advantages of the present disclosure will be more clearly understood from the following detailed description taken in conjunction with the accompanying drawings, in which.

DETAILED DESCRIPTION

Advantages, features, and methods for achieving those of embodiments may become apparent upon referring to embodiments described later in detail together with attached drawings. However, embodiments are not limited to the embodiments disclosed hereinafter, but may be embodied in different modes. The same reference numbers may refer to the same elements throughout the specification.

Figure 1:
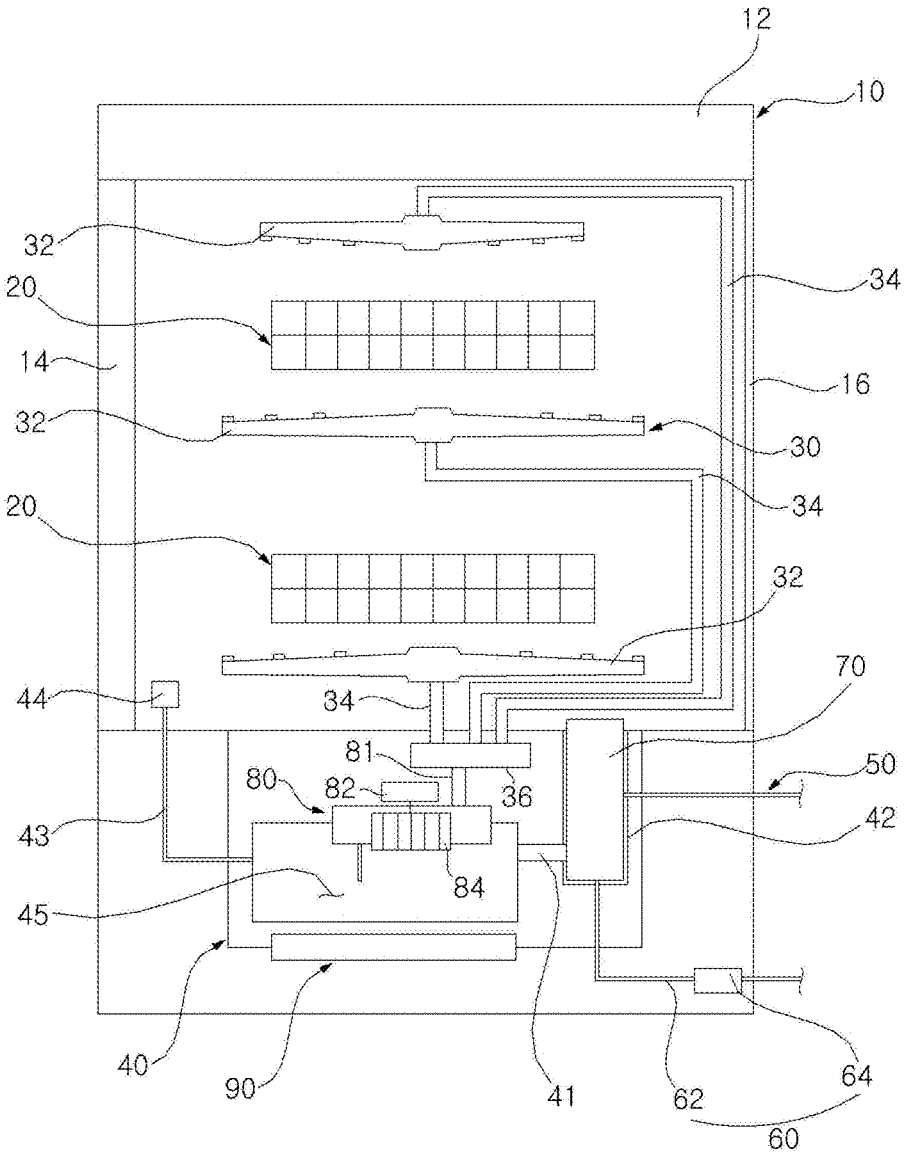
FIG. 1 is a sectional view schematically showing a dishwasher according to a first embodiment of the present invention.
Figure 2:
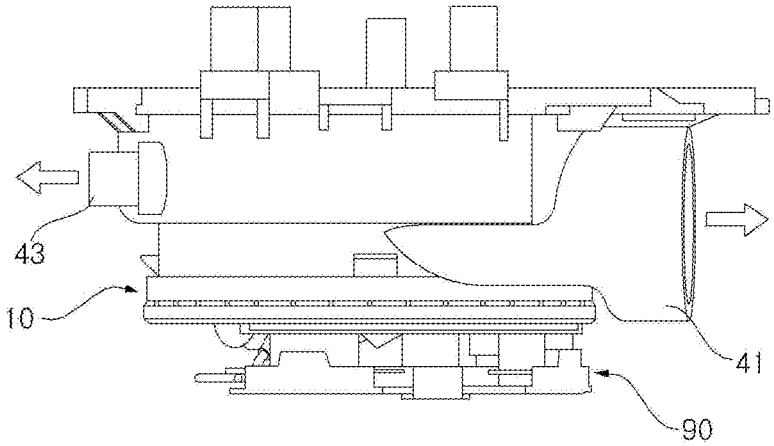
FIG. 2 is a front view of a sump shown in FIG. 1.
Figure 3:
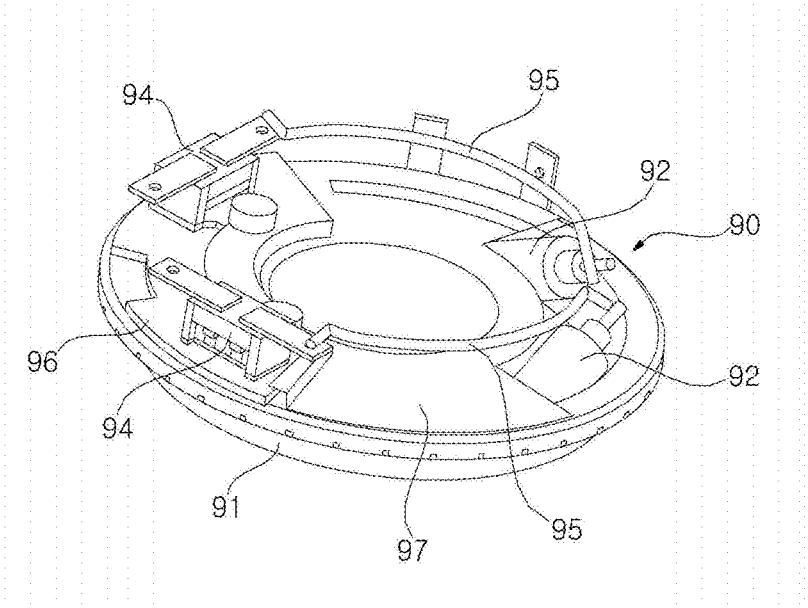
FIG. 3 is a bottom perspective view of a heater module shown in FIG. 2.
Figure 4:
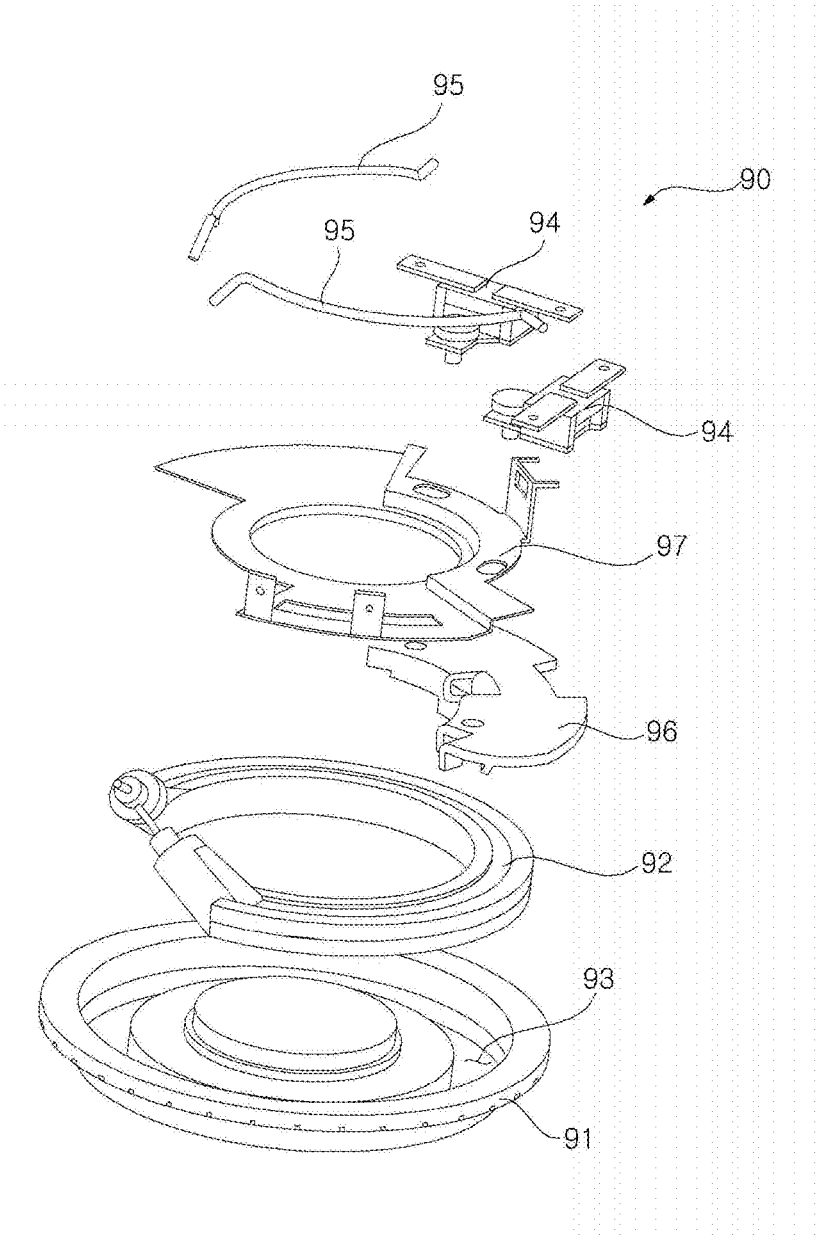
FIG. 4 is an exploded perspective view of FIG. 3.

FIG. 1 is a sectional view schematically showing a dishwasher according to a first embodiment of the present invention, FIG. 2 is a front view of a sump shown in FIG. 1, FIG. 3 is a bottom perspective view of a heater module shown in FIG. 2, and FIG. 4 is an exploded perspective view of FIG. 3.

Referring to the figures, the dishwasher according to a first embodiment includes a cabinet assembly 10 that defines the external appearance of the dishwasher, a rack 20 disposed in cabinet assembly 10 to receive dishes, a spray module 30 disposed in cabinet assembly 10 to spray wash water to the dishes, a sump 40 disposed in cabinet assembly 10 to supply wash water to spray module 30, a water supply module 50 configured to supply water to sump 40 or spray module 30, a drainage module 60 connected to sump 40 to discharge wash water out of the dishwasher, a filter 70 mounted in sump 40 to filter the wash water, and a heater module 90 mounted in sump 40 to heat the wash water.

Cabinet assembly 10 defines the external appearance of the dishwasher.

Cabinet assembly 10 includes a cabinet 12, a door 14 coupled to cabinet 12 to open and close cabinet 12, and a tub 16 mounted in cabinet 12 such that tub 16 contacts wash water or steam.

Cabinet 12 is open at the front thereof. Door 14 is mounted at the open front of cabinet 12. Tub 16 is disposed in cabinet 12. Tub 16 is also open at the front thereof. When door 14 is closed, door 14 closes the open front of tub 16. Door 14 prevents wash water or steam from leaking out of tub 16.

Rack 20 is mounted in tub 16. Dishes are received in rack 20.

Spray module 30 sprays wash water to the dishes. Spray module 30 includes spray nozzles 32 and nozzle channels 34 configured to supply wash water to spray nozzles 32.

In one embodiment, three spray nozzles 32 are provided. In addition, three nozzle channels 34 are also provided such that nozzle channels 34 correspond to the respective spray nozzles 32. A nozzle channel switching unit 36 is provided to selectively supply wash water to at least one of the nozzle channels 34.

In one embodiment, spray module 30 is configured to receive wash water from sump 40, which stores wash water, and to spray the received wash water. In another embodiment, water may be directly supplied to spray module 30 through water supply module 50.

Water supply module 50 receives water from the outside and supplies the received water to sump 40. In one embodiment, water from water supply module 50 is supplied to sump 40 via filter 70.

Drainage module 60 discharges wash water stored in sump 40 out of the dishwasher. Drainage module 60 includes a drainage channel 62 and a drainage pump 64.

Filter 70 filters foreign matter, such as food waste, from the wash water. Filter 70 is disposed in a wash water flow channel along which wash water flows from tub 16 to sump 40.

Sump 40 is provided with a filter installation portion 42, at which filter 70 is installed. A filter channel 41 configured to connect filter installation portion 42 to the interior of sump 40 is disposed in sump 40.

A water collection unit 45 configured to store wash water is disposed in sump 40.

A pump module 80 configured to feed wash water stored in sump 40 to spray module 30 is disposed in sump 40.

Pump module 80 includes a pump motor 82 and an impeller 84 connected to pump motor 82 such that impeller 84 can be rotated by pump motor 82. When impeller 84 is operated, wash water stored in sump 40 is fed to spray module 30.

In one embodiment, wash water is moved using impeller 84. In other embodiments, wash water may be moved in various manners.

Pump module 80 is connected to spray module 30 via a pump channel 81.

Sump 40 is connected to a steam channel 43 and a steam nozzle 44. Sump 40 sprays steam generated by heater module 90 into tub 16.

The steam in sump 40 may be sprayed into tub 16 through steam channel 43 and steam nozzle 44.

The steam generated in sump 40 may be supplied into tub 16 through filter channel 41 and filter installation portion 42. That is, the steam generated in sump 40 may be supplied into tub 16 through steam channel 43 or filter channel 41

Heater module 90 is mounted outside sump 40. Heater module 90 mounted outside sump 40 does not contact wash water.

Heater module 90 includes a heater cover 91 mounted to sump 40 such that heater cover 91 tightly contacts sump 40 to transfer heat to sump 40, a heater 92 installed in heater cover 91 to generate heat when electric power is applied to heater 92, and a temperature control module configured to control electric power applied to heater 92 based on the temperature of heater 92.

In one embodiment, heater cover 91 is mounted to the bottom surface of sump 40 such that heater cover 91 tightly contacts the bottom surface of sump 40. Heater cover 91 transfers heat to water collection unit 45, which is disposed above heater module 90.

In one embodiment, heater cover 91 is formed in a disc shape.

Heater cover 91 may be variously formed based on the shape of sump 40. For example, heater cover 91 may have a large area in order to uniformly transfer heat to the entirety of water collection unit 45

Heater cover 91 may be made of a material, such as aluminum or copper, which exhibits high thermal conductivity. Even though heater cover 91 is made of aluminum, heater cover 91 is not corroded, since heater cover 91 does not directly contact water.

Heater cover 91 may be provided with a heater installation portion 93, in which heater 92 is installed. Heater installation portion 93 is concavely formed in heater cover 91. Heater 92 is installed in heater installation portion 93.

Heater 92, which is installed in heater cover 91, may transfer heat to the entirety of heater cover 91 by conduction. Exposure of heater 92, which is installed in heater cover 91, to the outside is minimized.

In one embodiment, heater 92 is formed in a ring shape. Heater installation portion 93 is formed in a ring shape, which corresponds to the ring shape of heater 92.

In one embodiment, sump 40 is made of a synthetic resin material. Sump 40 heats the wash water stored in water collection unit 45 using the heat received from heater cover 91.

Since sump 40 is made of the synthetic resin material, sump 40 may be easily manufactured, and may be more accurately formed by injection molding than by metal die casting. Even though sump 40 may be made of the synthetic resin material, sump 40 is prevented from being melted or burned through temperature control performed by the temperature control module.

The temperature control module includes a temperature fuse 94 connected to heater 92 to regulate electric power based on the temperature of heater 92 and a wire 95 connected between temperature fuse 94 and heater 92.

The temperature control module may further include a thermal bridge 96 and a heater shield 97 to more easily install temperature fuse 94.

Thermal bridge 96 is disposed between heater 92 and temperature fuse 94. Thermal bridge 96 transfers heat from heater 92 to temperature fuse 94. Heater shield 97 is assembled to heater cover 91. Heater shield 97 prevents the exposure of heater 92 to the outside.

In one embodiment, heat is transferred to temperature fuse 94 through thermal bridge 96. In other embodiments, temperature fuse 94 may directly contact heater 92 such that heat from heater 92 is directly transferred to temperature fuse 94.

In heater module 90 according to one embodiment, heat is directly transferred to temperature fuse 94 by conduction. That is, heat transfer is achieved by conduction in heater module 90, whereby it is possible to more sensitively sense the change in temperature of heater 92. Consequently, it is possible for the temperature control module to more accurately control the temperature of heater 92.

In heater module 90 according to one embodiment, heat transfer is achieved by conduction, whereby heat transfer is rapidly performed. In heater module 90 according to one embodiment, time necessary for feedback from the temperature control module is short.

In the conventional dishwasher, the heater is disposed in the sump. As a result, it is not possible to directly sense the change in temperature of the heater. In the conventional dishwasher, the temperature of the heater is indirectly sensed based on the temperature of steam or wash water stored in the water collection unit.

In one embodiment of the present invention, the temperature control module directly contacts heater 92 to sense the temperature of heater 92. Consequently, it is possible to prevent heater 92 from overheating. Additionally, it is possible to save electricity and to prevent the dishwasher from being thermally damaged since the temperature control module directly senses the temperature of heater 92.

Since heater module 90 according to this embodiment is installed outside sump 40 such that heater module 90 is exposed to the outside, it is possible to easily repair heater module 90. In addition, it is possible to more easily replace heater module 90 when heater module 90 malfunctions while generating steam or becomes out of order.

And, since heater module 90 according to this embodiment does not contact water, it is possible to improve the durability of the heater, which generates heat.

Furthermore, it is possible to considerably reduce a possibility of an electric short from heater module 90 according to this embodiment.

As is apparent from the above description, the dishwasher according to embodiments of the present invention has one or more of the following effects.

First, the disclosed dishwasher has the effect of preventing corrosion or oxidation of the heater since the heater does not contact wash water.

Second, the disclosed dishwasher has the effect of improving the durability of the heater due to non-contact between the heater and wash water.

Third, the disclosed dishwasher has the effect of directly sensing heat generated by the heater module since the heater module is installed outside the sump.

Fourth, the disclosed dishwasher has the effect of more accurately controlling the temperature of the heater module since the temperature of the heater module is directly sensed.

Fifth, the disclosed dishwasher has the effect of easily repairing or replacing the heater module since the heater module is installed outside the sump.

Sixth, the disclosed dishwasher has the effect of maximizing thermal conductivity while minimizing corrosion of the heater since the heater cover, which transfers heat from the heater to the water collection unit by conduction, is made of aluminum.

Seventh, the disclosed dishwasher has the effect of reducing manufacturing cost of the sump since the sump, which defines the water collection unit, is formed by injection molding.

Eighth, the disclosed dishwasher has the effect of maximizing the area of the heater cover and uniformly transferring heat to the entirety of the water collection unit since the heater cover is installed outside the sump.

Ninth, the disclosed dishwasher has the effect of rapidly transferring heat to the entirety of the heater cover by conduction since the heater is installed in the heater cover.

It will be apparent that, although the preferred embodiments have been shown and described above, the present invention is not limited to the above-described specific embodiments, and various modifications and variations can be made by those skilled in the art without departing from the spirit of the appended claims.

What is claimed is:

1. A dishwasher comprising:

a cabinet assembly including a tub in which dishes are received;

a spray module disposed in the tub to spray wash water to the dishes in the tub;

a water collection unit coupled to the tub to receive and collect the wash water sprayed into the dishes by the spray module;

a water supply module connecting the water collection unit with a water source to guide the water supplied by the water source into the water collection unit;

a heater module comprising a heater cover mounted beneath a bottom surface of the water collection unit, and a heater to generate heat when electric power is supplied, the heater being mounted on the heater cover to heat the heater cover and located at the outside of the water collection unit;

a heater installation portion formed in the heater cover as a groove protruding towards the water collection unit, and a pump module mounted on a top surface of the water collection unit, the pump module comprising an impeller located inside the water collection unit, the wash water in the water collection unit being supplied to the spray module when the impeller rotates, and a motor located outside of the water collection unit to rotate the impeller, wherein at least a portion of the heater is inserted in the groove of the heater installation portion.

2. The dishwasher of claim 1, wherein the heater module comprises:

a temperature control module connected to the heater to control electric power applied to the heater based on temperature of the heater.

3. The dishwasher of claim 1, wherein the heater installation portion is formed in a ring shape.

4. The dishwasher of claim 2, wherein the temperature control module comprises:

a temperature fuse to regulate the electric power based on a temperature of the heater; and a wire electrically connected between the temperature fuse and the heater.

5. The dishwasher of claim 4, wherein the temperature control module further comprises:

a thermal bridge disposed between the heater and the temperature fuse to transfer the heat from the heater to the temperature fuse by thermal conduction.

6. The dishwasher of claim 2, wherein the temperature control module further comprises:

a heater shield coupled to the heater cover to prevent exposure of the heater to an outside.

7. The dishwasher of claim 1, wherein the steam in the water collection unit is supplied into the tub through a steam channel that connects the water collection unit and the tub and a filter channel that provide a flow path to guide the wash water in the tub into the water collection unit.

8. The dishwasher of claim 2, wherein the temperature control module comprises:

a temperature fuse to regulate the electric power based on a temperature of the heater;

a wire electrically connected between the temperature fuse and the heater; and a thermal bridge disposed between the heater and the temperature fuse to transfer the heat from the heater to the temperature fuse by thermal conduction.

9. A dishwasher comprising:

a cabinet assembly including a tub in which dishes are received;

a spray module disposed in the tub to spray wash water to the dishes in the tub;

a water collection unit coupled to an interior of the tub to collect the wash water sprayed into the dishes by the spray module;

a water supply module connecting the water collection unit with a water source to guide the water supplied by the water source into the water collection unit;

a heater module comprising:

a heater cover mounted beneath a bottom surface of the water collection unit;

a heater to generate heat when electric power is supplied, the heater being mounted on the heater cover to heat the heater cover and located at the outside of the water collection unit; and a heater installation portion formed in the heater cover as a groove protruding towards the water collection unit, and a pump module mounted on a top surface of the water collection unit, the pump module comprising:

an impeller located inside the water collection unit, the wash water in the water collection unit being supplied to the spray module when the impeller rotates; and a motor located outside of the water collection unit to rotate the impeller;

a steam channel connecting the water collection unit and the tub;

a filter channel configured to form a flow path to guide the wash water in the tub into the water collection unit; and a filter configured to filter the wash water flowing into the water collection unit by the filter channel, wherein at least a portion of the heater is inserted in the groove of the heater installation portion.

10. The dishwasher of claim 9, wherein the steam in the water collection unit is supplied into the tub through the steam channel and the filter channel.

11. The dishwasher of claim 9, wherein the heater module further comprises:

a temperature fuse to regulate the electric power based on a temperature of the heater;

a wire electrically connected between the temperature fuse and the heater; and a thermal bridge disposed between the heater and the temperature fuse to transfer the heat from the heater to the temperature fuse by thermal conduction.

* * * * *